US006283774B1

(12) United States Patent
Funatsu

(10) Patent No.: US 6,283,774 B1
(45) Date of Patent: Sep. 4, 2001

(54) HOT-LINE PLUG TERMINAL

(75) Inventor: Akira Funatsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/531,884

(22) Filed: Mar. 21, 2000

(30) Foreign Application Priority Data

Jun. 23, 1999 (JP) ..... 11-176797

(51) Int. Cl.[7] ..... H01R 13/53; H01R 13/02
(52) U.S. Cl. ..... 439/181; 439/862
(58) Field of Search ..... 439/181, 660, 439/668, 884, 885, 862; 200/51.1

(56) References Cited

U.S. PATENT DOCUMENTS

| | | | | |
|---|---|---|---|---|
| 2,625,576 | | 1/1953 | Gilbert . | |
| 3,275,765 | * | 9/1966 | Ferdon et al. | 200/51.1 |
| 3,474,380 | | 10/1969 | Miller . | |
| 3,663,930 | * | 5/1972 | Henschen et al. | 439/660 |
| 4,734,060 | * | 3/1988 | Kawawada et al. | 439/660 |
| 5,643,013 | | 7/1997 | Weidler . | |
| 5,971,809 | * | 10/1999 | Ho | 439/660 |
| 6,113,426 | * | 9/2000 | Lin | 439/607 |

FOREIGN PATENT DOCUMENTS

| | | |
|---|---|---|
| 1105022 | 12/1959 | (DE) . |
| 900332 | 7/1967 | (GB) . |
| 62-70371 | 5/1987 | (JP) . |
| 0071087 * | 3/1989 | (JP) . |

* cited by examiner

*Primary Examiner*—Paula Bradley
*Assistant Examiner*—James R. Harvey
(74) *Attorney, Agent, or Firm*—Kanesaka & Takeuchi

(57) ABSTRACT

A hot-line plug terminal (5) comprises a steady-state contact section (7B) and an initial arc contact section (7A) provided at a position which offset to a side of the steady-state contact section.

7 Claims, 8 Drawing Sheets

HOT-LINE PLUG TERMINAL

BACKGROUND OF THE INVENTION

1. Field of the Invention

The present invention relates to hot-line plug terminals and electrical connector having such a terminal.

2. Related Art

A terminal of this type is disclosed by, for example, Japanese UM patent application Kokai No. 62-70371.

As shown in FIG. 8, this terminal is made by bending a metal strip. The terminal 50 comprises a pair of contact pieces 51 making a substantially U-shaped form and a connection piece 52 extending downwardly from the contact pieces 51. The contact pieces 51 are curved so as to provide throat portions 51A and 51B at two different positions in the plugging direction of a mating pin 53.

Where the terminal 50 is used in a hot-line plug electrical connector, the first throat portion 51A makes an initial arc contact portion while the second throat portion 51B makes a steady state contact portion. In the hot-line plug electrical connector, the terminal is usually used as a power terminal. When a mating pin 53 is brought to the initial arc contact portion 51A, it makes an arc and then contact with the steady-state contact portion 51B. The arc carbonizes carbon containing matter in the atmosphere, and the carbonized matter adheres to the initial arc contact section 51A and the pin 53. The carbonized matter is brought to the steady-state contact section 51B by the plugged pin 53, making a poor contact.

SUMMARY OF THE INVENTION

Accordingly, it is an object of the invention to provide a hot-line plug terminal capable of preventing adverse effects of the arc upon the steady-state contact section and an electrical connector having such a terminal.

According to the invention there is provided a hot-line plug terminal comprising a steady-state contact section having a first front edge portion; and an initial arc contact section having a second front edge portion which extends forwardly more than the first front edge portion. The initial arc contact section is provided at a position offset to a side of the steady-state contact section.

When the terminal of a mating connector is brought to the initial arc contact terminal, an arc is produced between them. Then, the terminal makes stable contact with the steady-state contact section. The carbonized matter produced by the arc adheres to the mating terminal. However, according to the invention, the initial arc and steady-state contact sections are offset laterally so that the carbonized matter is not brought to the steady-state contact section by the initial arc contact section.

According to an embodiment of the invention, the first and second front edges form a step-like shape. The first and second front edges are tapered toward tips so as to facilitate plugging with the mating terminal. The initial arc contact section is provided on each side of the steady-state contact section so that if the mating terminal is inserted at an angle with respect to the longitudinal direction of the terminal, the production of an arc at the initial arc contact section is ensured. The steady-state contact section is provided with a protruded portion so that even if carbonized matter flies around the protruded portion, the stable contact with the steady-state contact section is maintained. It is preferred that the protruded portion is elongated in the longitudinal direction of the terminal.

According to another aspect of the invention there is provided a hot-line plug electrical connector comprising such a terminal as described above.

DESCRIPTION OF THE PREFERRED EMBODIMENTS

Embodiments of the invention will now be described with reference to FIGS. 1–7.

Figure 1A:
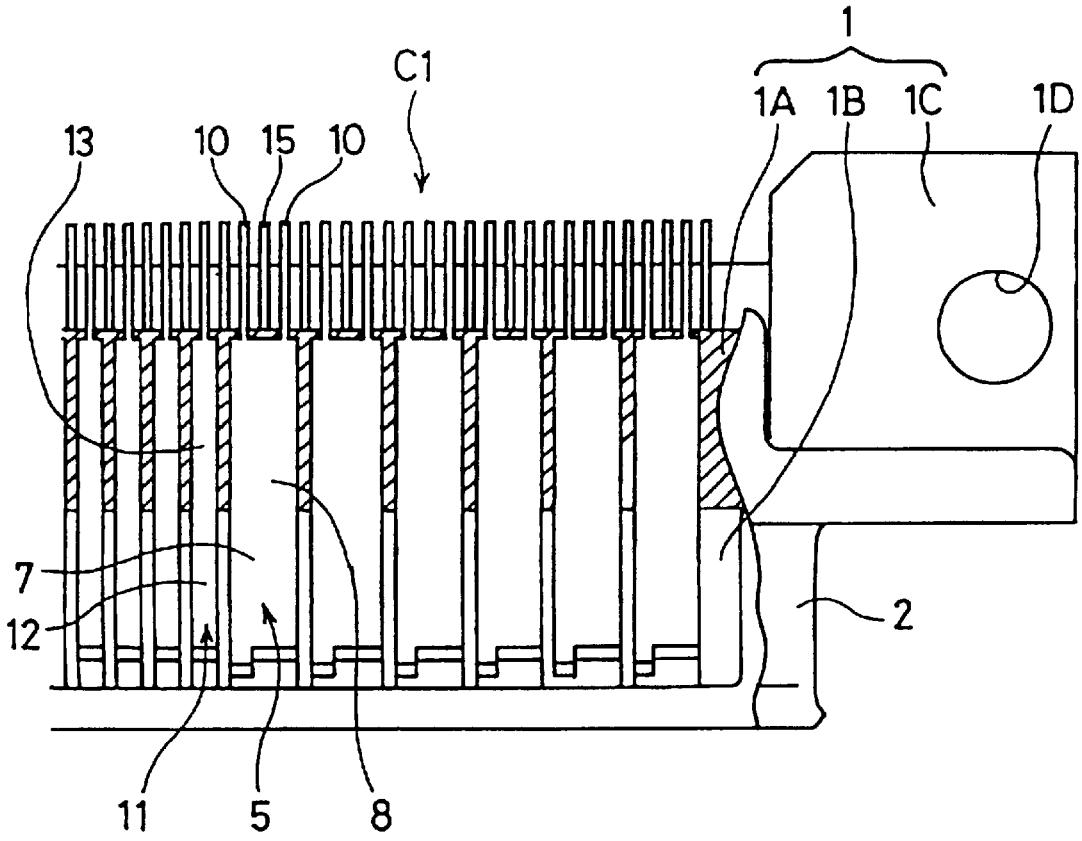
FIG. 1A is a top plan view, partially section, of an electrical connector according to an embodiment of the invention.
Figure 1B:
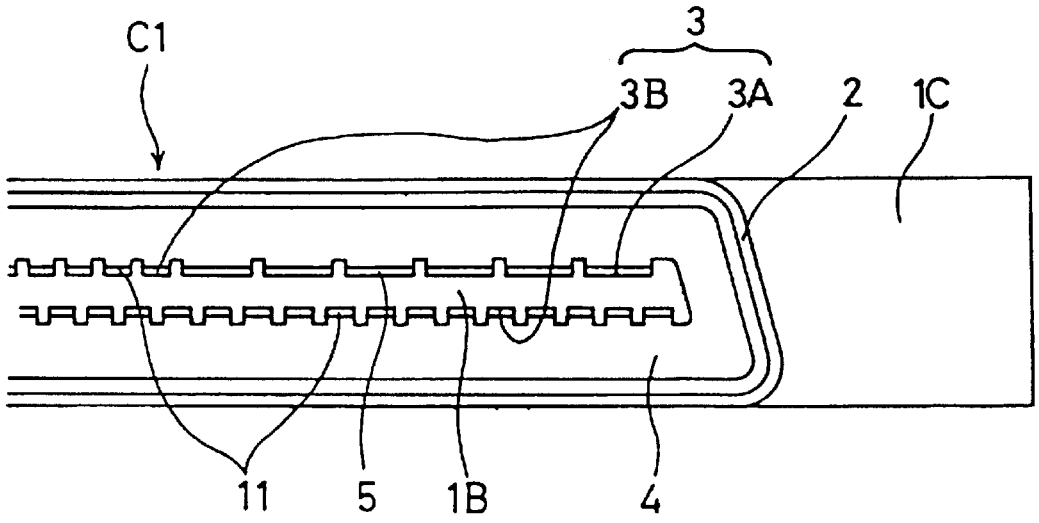
FIG. 1B is a front elevational view of the electrical connector.

In FIGS. 1A and B, an electrical connector C1 comprises a housing 1 which is made of a dielectric material so as to have an elongated substantially rectangular shape and a guiding tube 2 which covers the housing 1. The housing 1 comprises a body section 1A, a support plate section 1B extending forwardly from the body section 1A, and a fixing section 1C extending laterally from the body section 1A. A fixing hole 1D for a screw, etc. is provided in the fixing section 1C to fix the housing 1 to, for example, a circuit board P. The support plate section 1B is situated at a middle of the height of the housing 1 and provided with a plurality of grooves 3 on the upper and lower sides.

The electrical connector C1 comprises two types of terminals: signal terminals 11 and power terminals 5 which wider than the signal terminals so that the grooves 3 are provided in the corresponding two types 3A and 3B. The width of the grooves 3A for power terminals is approximately twice that of the signal terminal grooves 3B. The power terminal grooves 3A are provided at predetermined intervals in the longitudinal direction on a half of the upper surface of the support plate section 1B while the signal terminal grooves 3B are provided at predetermined intervals in the other half of the upper surface and the lower surface of the support plate section 1B.

Figure 2:
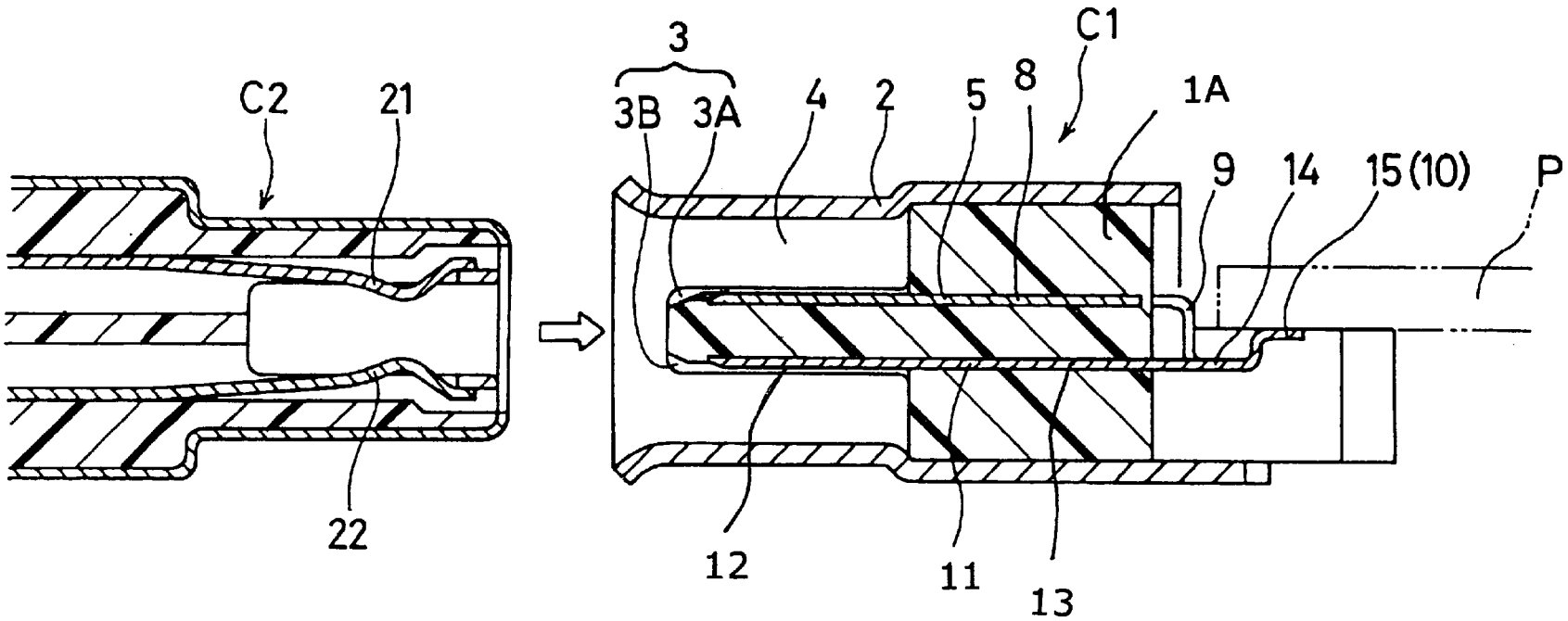
FIG. 2 is a sectional view of the electrical connector and a mating connector.

In FIG. 2, a receiving space 4 is formed between the support plate section 1B and the guiding tube 2 to receive a mating connector C2. The mating connector C2 comprises power terminals 21 and signal terminals 22 corresponding to the connector C1.

Figure 3A:
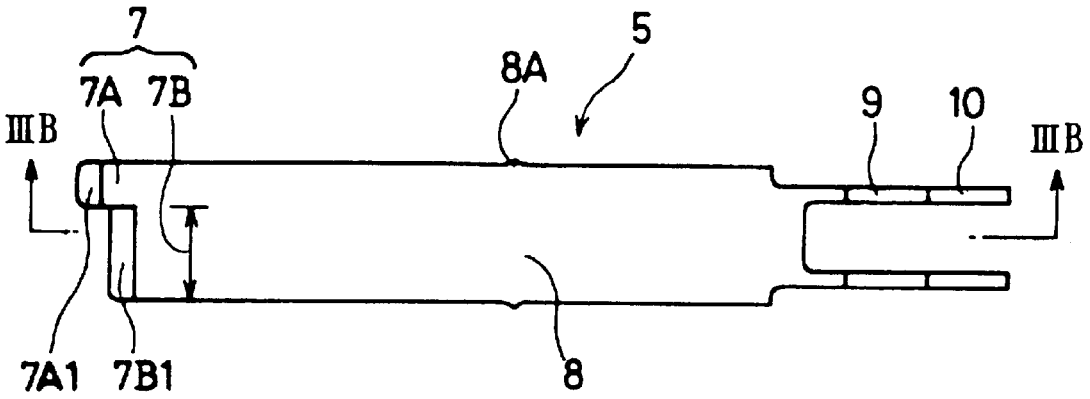
FIG. 3A is a top plan view of a power terminal for the electrical connector.
Figure 3B:
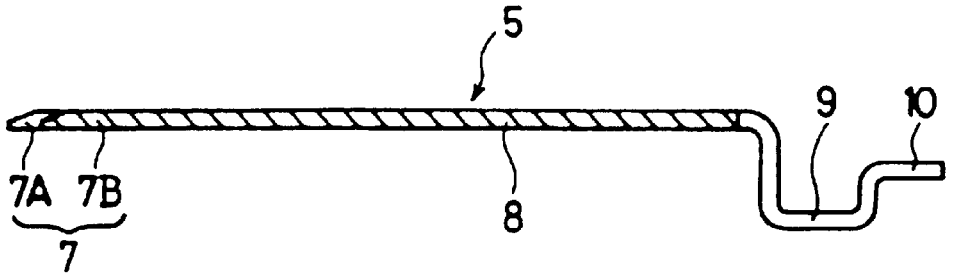
FIG. 3B is a sectional view taken along line IIIB—IIIB of FIG. 3A.

In FIG. 3A, the power terminal 5 is formed of a metal strip so as to provide at one end a flat contact section 7 and at the other end a pair of connection legs 10. The contact section 7 is divided into two portions 7A and 7B wherein the contact portion 7A extends forwardly more than the contact portion 7B. Each of the contact portions 7A and 7B has a tapered front edge 7A1 or 7B1. The contact portion 7A makes an arc prior to contact with the power terminal of a mating connector, forming an initial arc contact portion. The contact portion 7B forms a steady-state contact portion. A pair of barbs 8A are provided on an intermediate section 8 to engage the housing 1 for attachment. As shown in 3B, the connection legs 9 are curved to provide connection portions 10 at the ends. The connection portions 10 are situated substantially at a half of the thickness of the support plate section 1B.

As shown in FIG. 2, the signal terminal 11 is made of a metal strip so as to provide a flat contact section 12 at one end and connection legs 15 at the other end. The intermediate sections 8 and 13 of the power and signal terminals 5 and 11 are supported by the body section 1A such that the contact sections 7 and 12 are placed in the terminal grooves 3A and 3B, respectively, while the connection legs 9 and 14 project rearwardly from the body section 1A such that the connection portions 10 and 15 are placed on the same circuit board.

Figure 4A:
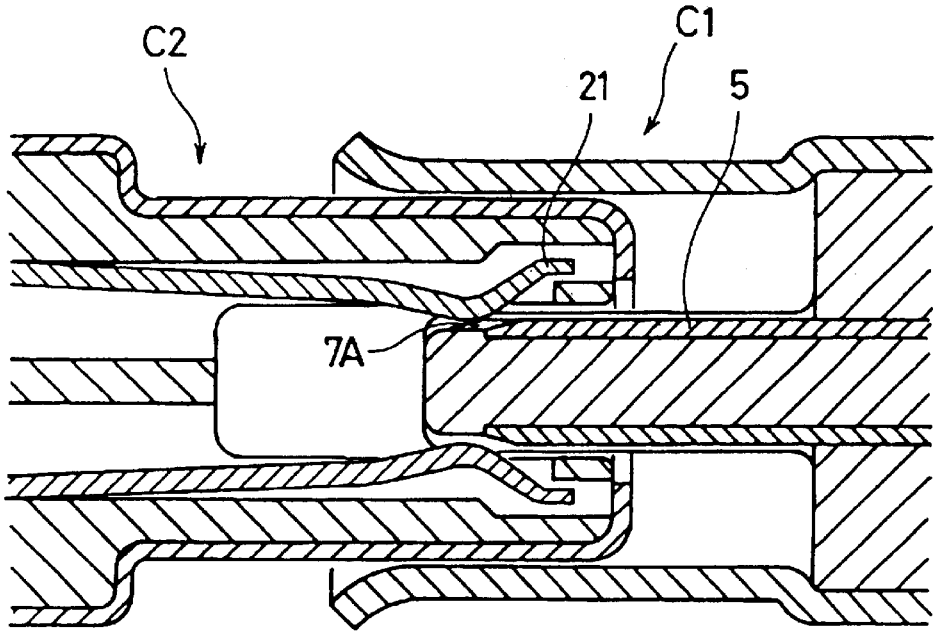
FIG. 4A is a sectional view wherein the mating connector is being plugged into the electrical connector.
Figure 4B:
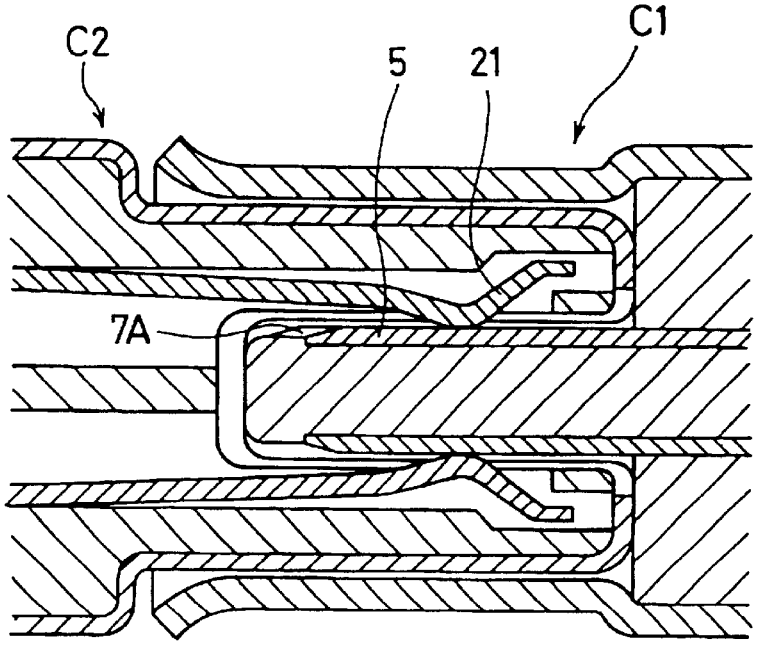
FIG. 4B is a sectional view wherein the mating connector has been plugged in the electrical connector.

As shown in FIGS. 4A and 4B, the mating connector C2 is plugged into the connector C1 such that the respective power and signal terminals are electrically connected. The power terminal 21 of the mating connector C2 is brought to the initial arc contact portion 7A of a power terminal 5 and makes an arc therewith and then makes a steady-state contact with the steady-state contact portion 7B. Since the arc is already produced between the power terminal 21 and the initial arc contact portion 7A, the subsequent contact with the steady-state contact portion 7B makes no arc. Since the initial arc contact portion 7A is offset laterally from the steady-state contact portion, the carbonized matter does not reach the steady-state contact portion 7B when the mating terminal 21 makes a complete contact with the power terminal 5.

Figure 5A:
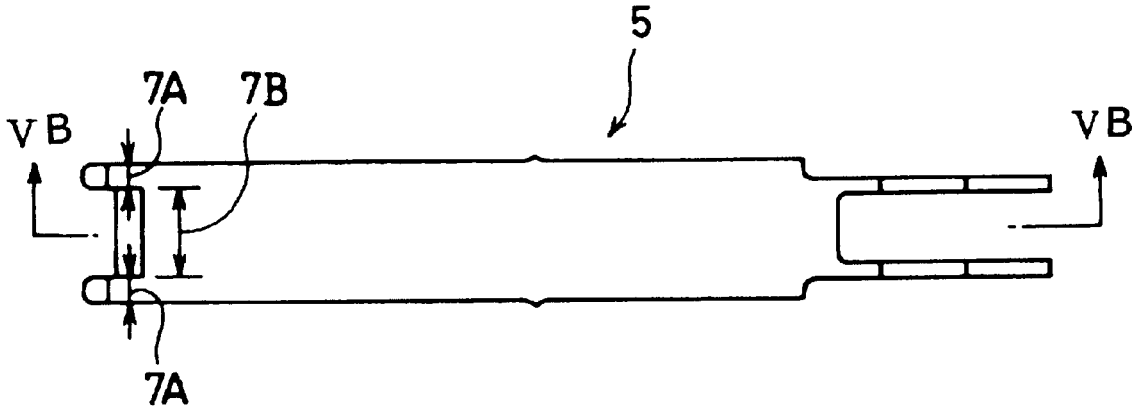
FIG. 5A is a top plan view of a terminal according to another embodiment of the invention.
Figure 5B:
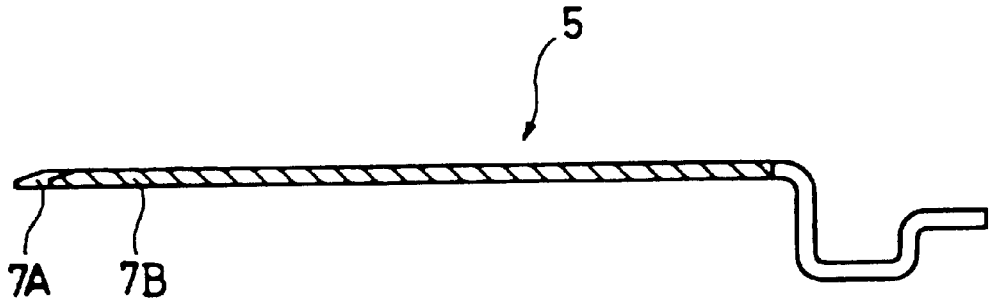
FIG. 5B is a sectional view taken along line VB—VB of FIG. 5A.

In FIG. 5, a pair of initial arc contact sections 7A extend forwardly from opposite sides of the steady-state contact section 7B so as to assure that at least one of the initial arc contact sections 7A makes an arc with the mating terminal even if the mating terminal is shifted or tilted laterally.

Figure 6A:
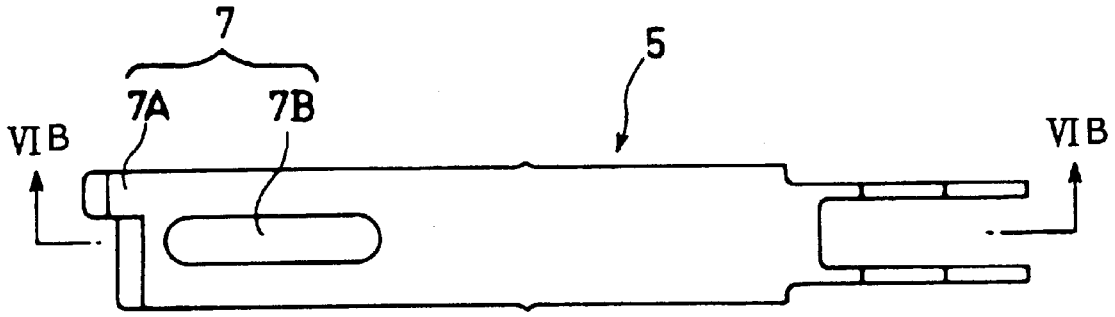
FIG. 6A is a top plan view of a terminal according to still another embodiment of the invention.
Figure 6B:
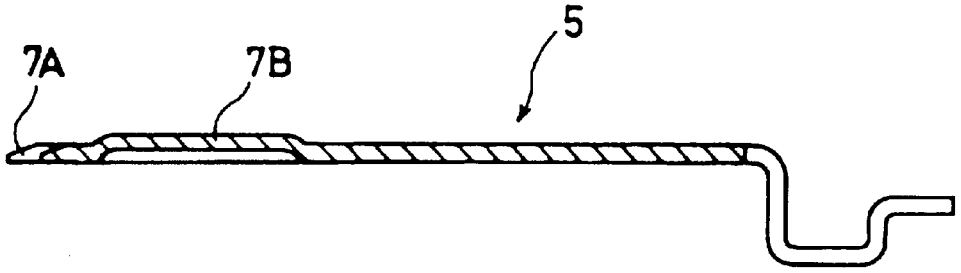
FIG. 6B is a sectional view taken along line VIB—VIB of FIG. 6A.

In FIG. 6, a steady-state contact section 7B is formed as a protruded portion so that the matter produced by the initial arc hardly reaches the top of the steady-state contact section 7B.

Figure 7A:
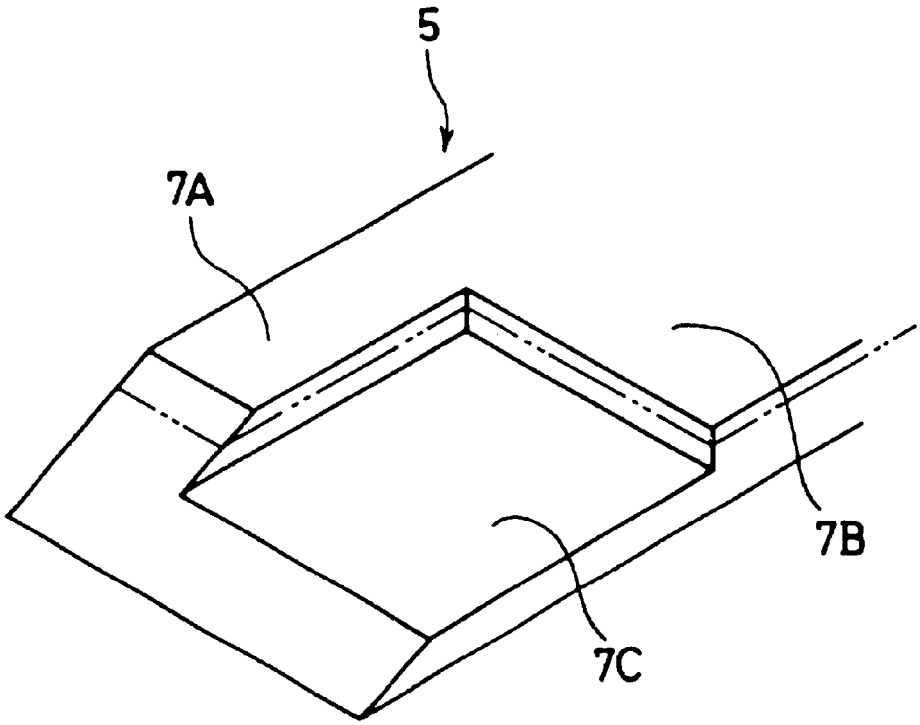
FIG. 7A is a perspective view of a terminal prior to molding according to yet another embodiment of the invention.
Figure 7B:
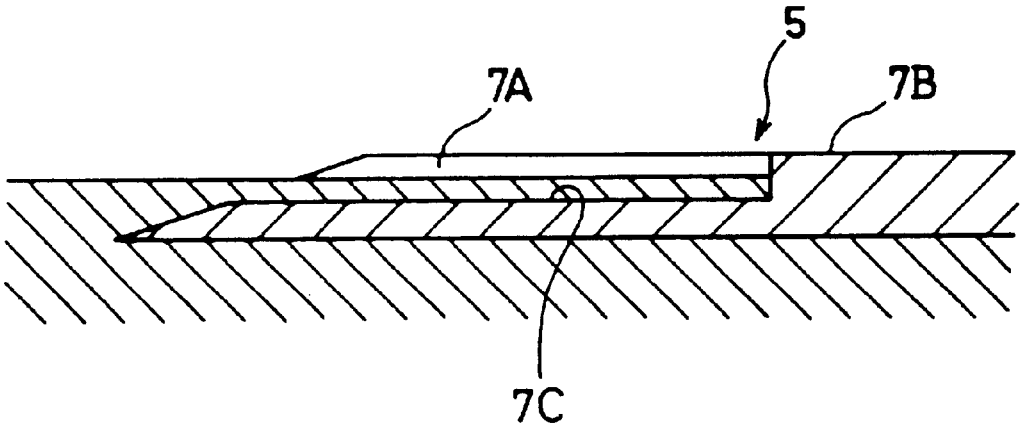
FIG. 7B is a sectional view of the terminal of FIG. 7A after molding.
Figure 8:
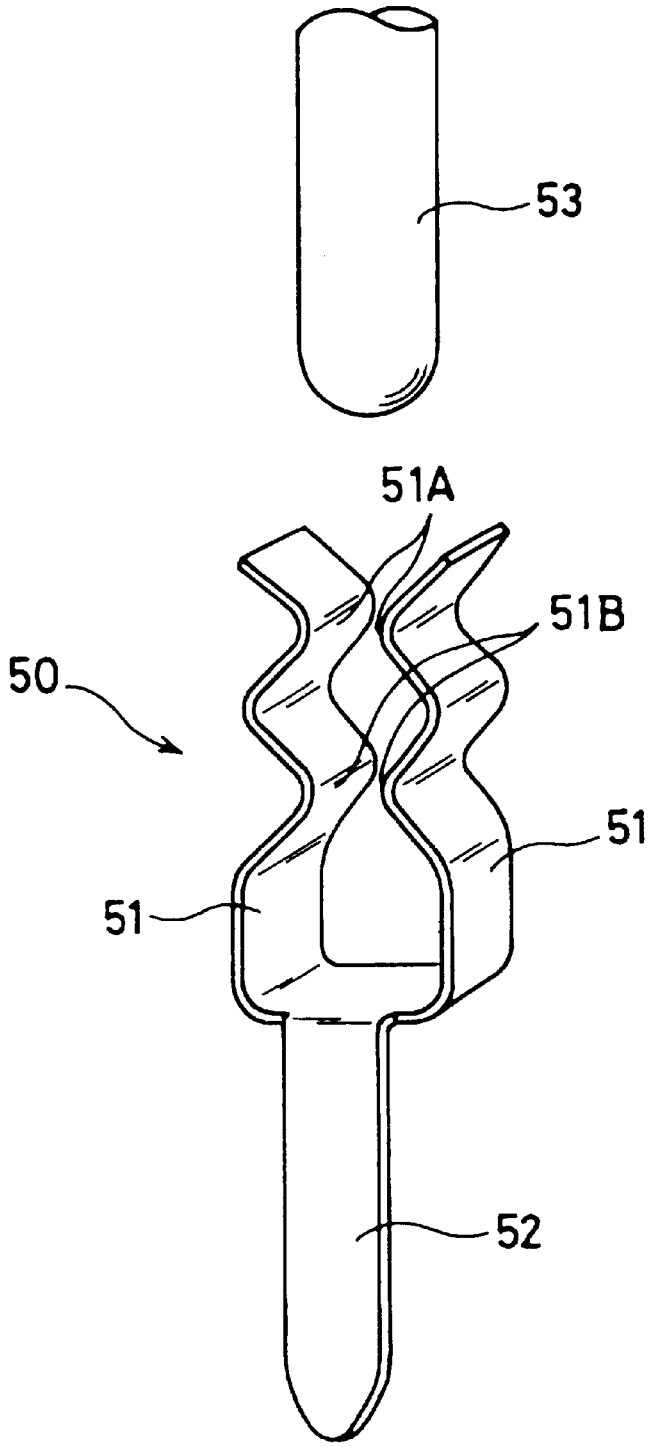
Fig. 8 PRIOR ART
FIG. 8 is a perspective view of a conventional terminal.

In FIG. 7(A), a step-down portion 7C having a width substantially equal to the width of the steady-state contact section 7B is provided on the terminal 5. Then, the terminal 5 is molded up to the phantom line to cover the step-down portion 7C, forming the initial arc and steady-state contact portions 7A and 7B, respectively, as shown in FIG. 7(B).

Since the initial arc contact section is shifted laterally from the steady-state contact section, the carbonized matter produced by the arc does not reach the steady-state contact section, thus making a stable contact at the steady-state contact section.

What is claimed is:

1. A hot-line plug terminal made of a flat-shaped metal plate, comprising:

a steady-state contact section having a first front edge portion; and an initial arc contact section having a second front edge portion which extends forwardly more than said first front edge portion, wherein said steady-state and initial arc contact sections are provided in the plane of said hot-line plug terminal at positions offset from each other in a widthwise direction of said hot-line plug terminal.

2. A hot-line plug terminal according to claim 1, wherein said first and second front edge portions form a step-like shape.

3. A hot-line plug terminal according to claim 1, wherein said first and second front edge portions are tapered toward tips.

4. A hot-line plug terminal according to claim 1, wherein said initial arc contact section is provided on each side of said steady-state contact section.

5. A hot-line plug terminal according to claim 1, wherein said steady-state contact section is provided with a protruded portion.

6. A hot-line plug terminal according to claim 5, wherein said protruded portion is elongated in the longitudinal direction of said terminal.

7. A hot-line plug electrical connector comprising a terminal according to claim 1.

* * * * *